US009396733B2

(12) United States Patent
Pun et al.

(10) Patent No.: US 9,396,733 B2
(45) Date of Patent: Jul. 19, 2016

(54) REVERSIBLE AUDIO DATA HIDING

(71) Applicant: University of Macau, Macau (CN)

(72) Inventors: Chi-Man Pun, Macau (CN); Ka-Cheng Choi, Macau (CN); C. L. Philip Chen, Macau (CN)

(73) Assignee: UNIVERSITY OF MACAU, Macau (CN)

( * ) Notice: Subject to any disclaimer, the term of this patent is extended or adjusted under 35 U.S.C. 154(b) by 150 days.

(21) Appl. No.: 14/270,801

(22) Filed: May 6, 2014

(65) Prior Publication Data

US 2015/0325246 A1 Nov. 12, 2015

(51) Int. Cl.
*G10L 19/018* (2013.01)

(52) U.S. Cl.
CPC ..... *G10L 19/018* (2013.01)

(58) Field of Classification Search
CPC G10L 15/02; G10L 19/018; G11B 20/00086; G11B 20/00891; G11B 20/00884; H04H 20/31; H04H 60/48; H04N 9/8042; H04N 9/8047; H04N 2005/91335; H04N 2201/3233; H04N 2201/327; H04N 2201/328; H04N 2201/3283; G06T 2201/0052; G06F 21/10; G06F 2221/2107; G06F 2211/007; G06F 1/16; G06F 1/00; G06F 21/00
USPC ..... 713/176, 177, 180, 186; 380/255, 269; 705/50, 51; 704/205, 206, 243; 382/100
See application file for complete search history.

(56) References Cited

U.S. PATENT DOCUMENTS 6,141,017 A * 10/2000 Cubillo ..... G06T 3/4023 345/473
6,862,582 B2 * 3/2005 Harada ..... G06F 21/10 380/255
6,983,057 B1 * 1/2006 Ho ..... G06T 1/0035 375/E7.089
8,140,331 B2 * 3/2012 Lou ..... G11B 27/28 704/205
2002/0027994 A1 * 3/2002 Katayama ..... G10L 19/018 380/269

OTHER PUBLICATIONS

Ka-Cheng Choi, Chi-Man Pun, C.L. Philip Chen, "Application of a generalized difference expansion based reversible audio data hiding algorithm", Multimedia Tools and Applications, Dec. 4, 2013, Springer US.
Brett Bradley, Adnan M. Alattar, "High-capacity invertible data-hiding algorithm for digital audio," Security, Steganography, and Watermarking of Multimedia Contents VII, Mar. 21, 2005, pp. 789-800, vol. 5681, SPIE.
Chen Otc, Liu C-H, "Content-Dependent Watermarking Scheme in Compressed Speech With Identifying Manner and Location of Attacks", IEEE Transactions on Audio, Speech, and Language Processing, Jul. 2007, pp. 1605-1616, 15-5, IEEE.

(Continued)

*Primary Examiner* — Thanhnga B Truong
(74) *Attorney, Agent, or Firm* — Bacon & Thomas, PLLC

(57) ABSTRACT

The present invention provides a method of reversible audio data hiding. The method of data hiding and restoring comprises the steps of: protecting audio by embedding information into the audio according to variance calculation associated to the audio, wherein the quality of the protected audio is degraded after embedding the information into the audio; publishing the protected audio widely as a trial for listen version; and decoding the protected audio for a user who purchased the copyright of the audio by extracting the original audio from the protected audio.

16 Claims, 8 Drawing Sheets

(56) References Cited

OTHER PUBLICATIONS

Goto M, et al., "RWC Music Database: Music genre database and musical instrument sound database", Proceedings of the 4th International Conference on Music Information Retrieval (ISMIR 2003), Oct. 2003, pp. 229-230, ISMIR.

Huang X, et al., "A New Approach of Reversible Acoustic Steganography for Tampering Detection", 2010 Sixth International Conference on Intelligent Information Hiding and Multimedia Signal Processing (IIH-MSP), Oct. 15, 2010, pp. 538-542, IEEE.

Li M, et al., "Reversible Watermarking for Compressed Speech," Eighth International Conference on in Intelligent Systems Design and Applications (ISDA '08), Nov. 26, 2008, pp. 197-201, IEEE.

Nishimura A, "Reversible Audio Data Hiding Using Linear Prediction and Error Expansion", 2011 Seventh International Conference on Intelligent Information Hiding and Multimedia Signal Processing (IIH-MSP), Oct. 14, 2011, pp. 318-321, IEEE.

Van Derveenm, et al., "High capacity reversible watermarking for audio", Security and Watermarking of Multimedia Contents V, Jun. 13, 2003, pp. 1-11, SPIE.

Wang X, et al., "Efficient Generalized Integer Transform for Reversible Watermarking", Signal Processing Letters, Jun. 2010, pp. 567-570, 17-6, IEEE.

Yan D, Wang R, "Reversible Data Hiding for Audio Based on Prediction Error Expansion," International Conference on Intelligent Information Hiding and Multimedia Signal Processing (IIHMSP '08), Aug. 15, 2008, pp. 249-252, IEEE.

Yang Y, et al. "A Novel Audio Watermarking Algorithm for Copyright Protection Based on DCT Domain", Second International Symposium on Electronic Commerce and Security (ISECS '09), May 22, 2009, pp. 184-188, IEEE.

* cited by examiner

REVERSIBLE AUDIO DATA HIDING

TECHNICAL FIELD

The present invention is directed to reversible audio data hiding, in particular, is directed to a generalized difference expansion based reversible audio data hiding algorithm.

BACKGROUND

Many valuable reversible watermarking algorithms have been published up to today, mostly in the field of image processing, there are also some methods for reversible audio data hiding have been proposed, which can be categorized into three classes based on the embedding data domain: waveform domain, spectral domain and compressed data domain.

With the waveform as the embedding data domain, data embedding is carried out directly on the audio waveform, this type of data hiding techniques is usually simple and less computation is required. This technique makes use of an integer coefficient predictor to obtain the prediction error of the original audio. Location map that records expandability of audio samples are then embedded together with the watermark by prediction error expansion.

For data hiding using spectral domain, the audio waveform is first transformed to frequency domain by integer conversion before the embedding process, and inverse transform is needed after embedding to give out the stego audio waveform. For example, Integer Discrete Cosine Transform (intDCT) in the transformation of the audio waveform uses hash function to extract feature value of the original content, and amplitude expansion is employed in high frequency spectrum to embed the feature value for tamper detection. As the method is intended for tamper detection, most of the space is occupied by the overhead including the feature value and positional data, so not much embedding space is left for other payload.

Reversible audio watermarking techniques with compressed embedding data domain compress the unimportant parameters in the audio to provide space for data embedding, and the compression algorithm used usually utilizes linear prediction model. For example, a reversible watermarking method for compressed speech by entropy coding is provided and this scheme can be applied in different speech coding standards. However, it has a limited embedding capacity.

SUMMARY

The present invention provides a reversible audio data hiding by at least a data processing unit. The method of data hiding and restoring comprises the steps of: protecting audio by embedding information into the audio according to variance calculation associated to the audio, wherein the quality of the protected audio is degraded after embedding the information into the audio; publishing the protected audio widely as a trial for listen version; and decoding the protected audio for a user who purchased the copyright of the audio by extracting the original audio from the protected audio.

Preferably, the step of protecting comprises: obtaining an audio data array from the audio, partitioning the audio data array according to the variance calculation of the audio data array and combining the information with the partitioned audio data array.

Preferably, the variance calculation comprises the step of forming a bit array variance $V=\{V(i)\}$, wherein $V(i)$ is bitwise variance which is found for every bigit of the audio data array, and wherein $V(i)=\Sigma_{k=1}^{m/n} v(x_{ik})$ and $V(X_{ik})=\Sigma_{j=1}^{n}(x_{ikj}-a(x_{ik}))^2$, where m is the length of the audio data array, n is the length of the segments of the audio data array, $x_{ik}$ is a segment vector of the $k^{th}$ segment of bigit i and $a(x_{ik})$ is the rounded average of $x_{ik}$.

Preferably, the step of partitioning the audio data array comprises the step of getting an index array formed by index of bit array variance according to the sorting of the bitwise variances in descending order.

Preferably, the bigit i is from 1 to 16 and wherein the audio data array is obtained by 16-bit quantization of the audio waveform.

Preferably, the step of partitioning the audio data array comprises the step of assigning 8 most significant elements of the index array to a first index group and a second index group alternately, assigning the first and the third elements from the rest 8 least significant elements of the index array, and assigning the second and the fourth elements from the rest 8 least significant elements of the index array, and assigning the rest four elements of the index array into the first and the second index groups, with two elements in each index group.

Preferably, the step of partitioning the audio data array comprises partitioning the audio data array into two portions, according to the sorted first and second index groups with their elements as the locations of the corresponding bigits.

Preferably, the step of partitioning the audio data array comprises representing the first and the second index groups as a partition bit array, wherein elements in same group are represented by marking corresponding index of the partition bit array with element value as the index by the same bit value, and wherein the group with bigit 1 as its element is marked as "1" in the partition bit array while the other group is marked as "0".

Preferably, the step of combining the information with the partitioned audio data array comprises dividing the audio data array into a first and a second divided arrays according to the partition bit array, splitting the information into a first information portion and a second information portion, combining the first information portion with the first divided array as a first combined array by performing a generalized integer transform based data hiding process, combining the second information portion with the second divided array as a second combined array by performing the generalized integer transform based data hiding process, combining the first combined array with the second combined array as an information embedded array; and converting the information embedded array to an information embedded audio data with audio format and giving out information embedded audio waveform.

Preferably, the step of decoding further comprises obtaining an information embedded audio data array by sampling the information embedded audio waveform with a same sample rate as the data processing unit sampling the audio waveform, obtaining the partition bit array, partitioning the information embedded audio data array back into the first combined array and the second combined array according to the indication from the partition bit array, restoring the original audio data array and the original information by performing a generalized integer transformation based extraction on the first and the second combined arrays.

DESCRIPTION OF THE EMBODIMENTS

Before the statements of the present invention, the generalized reversible watermarking scheme that was based on is briefly reviewed. Wang X et al (2010) introduces "Efficient Generalized Integer Transform for Reversible Watermarking; Signal Processing Letters, IEEE 17:567-570" which would be utilized by the present invention in the later description. The image reversible watermarking scheme based on proposed a generalized integer transform function that embeds payload into the given image efficiently and allows the marked image being restored. With this integer transform, n−1 bits can be embedded into n pixels, where n is a positive integer. At first, the image is divided to non-overlapping blocks of length n, the blocks are then categorized into embeddable (E), changeable (C) and others (0). The set embeddable contains the block that does not cause overflow or underflow after data embedding by transform, and its variation v(x) should not greater than a preselected threshold t, $V(x)\leq t$, where $V(x)=\sqrt{\Sigma_{i-1}^{n}(x_1-a(x))^2}$. Changeable is a set that contains blocks with v(h(x)) not greater than t, $V(h(x))\leq t$ also written as $V_h(x)\leq t$, except those blocks in embeddable set. Others contain the rest of the blocks, the blocks that do not in embeddable set and with $V_h(x)>t$. Followed by, a location map recording E∪C are built, '1' is assigned to represent embeddable blocks and '0' is assigned for changeable blocks, and it is losslessly compressed for embedding.

Embedding of the compressed location map starts from the first pixel block in the image, for different types of blocks, different actions are carried out in embedding:

- For E, the transform is used. Since $V_h(x')=V(x)$ after the transform as explained in the introduction of Wang X et al above and embeddable blocks has $V(x)\leq t$, so $V_h(x')\leq t$.
- For C, the LSBs of the first n−1 pixels of the block will be replaced by the embedded bits, the LSBs replacement action dose not affect the value of $V_h(x)$, so $V_h(x')\leq t$ as changeable block originally has the property $V_h(x)\leq t$. And the original LSBs are stored in the bit string $C_{LSB}$.
- For O, blocks in it has the property $V_h(x)\leq t$ and the blocks are kept unchanged in embedding procedure, so the value of $V_h(x)$ remains the same and $V_h(x')>t$.

With the property that O can be precisely distinguished from E∪C through $V_h(x')$ at the decoder side, this is the reason why the location map only defines for the blocks in E∪C.

Finally, for the bit string $C_{LSB}$ and the watermark, they are embedded into the remaining embeddable blocks by the integer transform, and at last, we get the watermarked image.

Figure 1A:
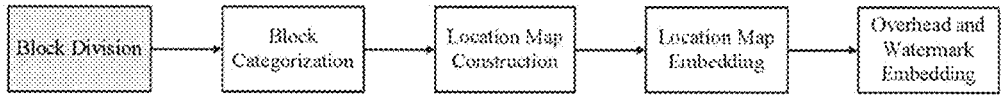
FIG. 1*a* shows a process modified to accept 1D input.
Figure 1B:
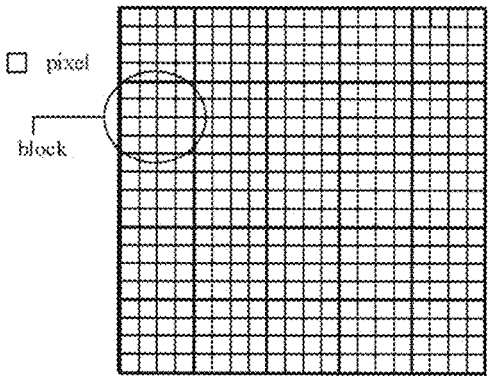
FIG. 1*b* shows the division procedure of FIG. 1*a* in image approach.
Figure 1C:
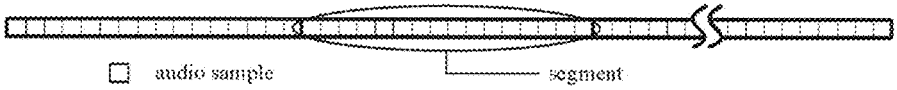
FIG. 1*c* shows a division procedure of FIG. 1*a* in audio approach.

FIG. 1*a* shows a process modified to accept 1D input, FIG. 1*b* shows the division procedure of FIG. 1*a* in image approach and FIG. 1*c* shows a division procedure of FIG. 1*a* in audio approach. FIGS. 1*a-c* show a basic idea how to watermark audio data with pixels of image having a different sampled size from said audio data.

Since the exemplary image reversible watermarking scheme based on is designed for e.g. squared 8-bit grayscale image, in order to customize it to be able to work with audio domain, the scheme is modified to be able to accept one-dimensional input. Way to do this is simply modify the division procedure of the data hiding process and other procedures remain the same as shown in FIGS. 1*a-c*. In the image approach (FIG. 1*b*), an image is divided into small blocks which are then classified into different categories. In audio approach (FIG. 1*c*), instead of dividing input into small blocks for processing, audio is cut into segments for further processing. Actions carried out to the segments will be the same as those for the pixel blocks in image approach. In this way, the scheme now can process audio input, but only 8-bit quantization audio is allowed. Yet, most commonly existing audio is 16-bit quantization, therefore, intelligent partitioning which will be discussed in the following description also solves the sample size issue.

Intelligent Partitioning.

Due to common difference of sample size for e.g. 8 bit image and 16 bit quantization audio, we choose to partition the 16 bit audio into two portions for data hiding. In order to divide the audio waveform into two portions, intelligent partitioning is applied in the embedding procedure of the proposed audio method. In the following description, the detailed operations carried out in intelligent partitioning are defined.

Figure 2:
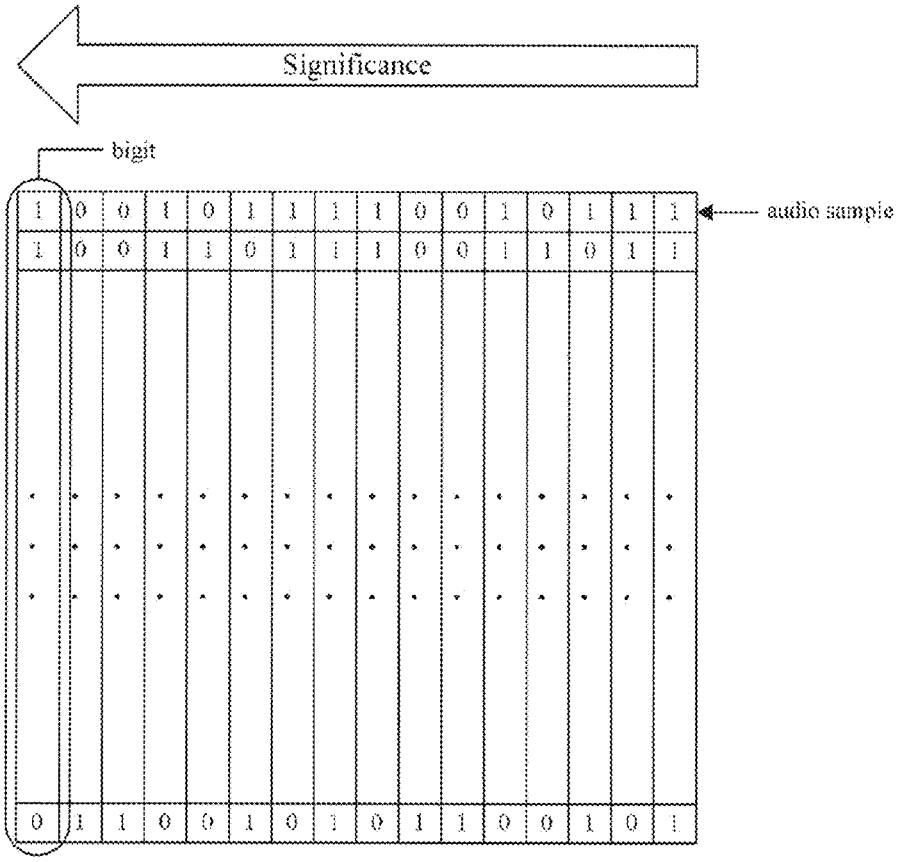
FIG. 2 shows an exemplary view of 16 bigit arrays of audio waveform.

FIG. 2 shows an exemplary view of 16 bigit arrays of audio waveform. Referring to FIG. 2, in the partitioning process, we may consider the audio waveform as 16 individual arrays, each bigit as one as shown in FIG. 2. Each column is an audio sample, and each row is a bigit array of the waveform. To partition the 16 bit quantization audio into two portions, two groups of 8 bigit arrays are formed, the grouping combination is determined with the target of high embedding space.

Figure 3:
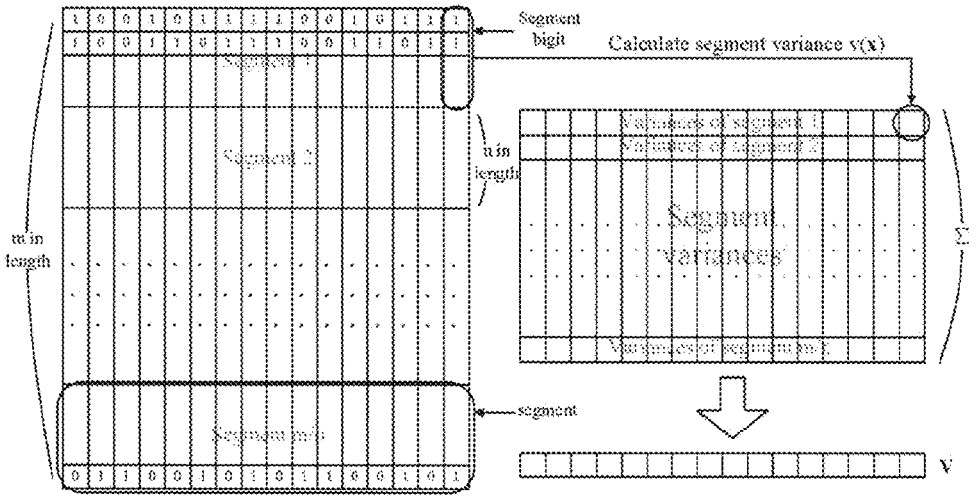
FIG. 3 shows the performance of variance calculation according to the exemplary arrays of the audio waveform of FIG. 2.

FIG. 3 shows the performance of variance calculation according to the exemplary arrays of the audio waveform of FIG. 2. With the input audio waveform M (as the form of waveform array), first find the variance vector V as shown in FIG. 3, where in is the length of the waveform and n is size of the segment. Variance vector V is a vector that shows the sum of the segment variances for every bigits of the waveform array M, where the segment variance is a bitwise variance of the segment, and the segments are equal-sized fragments of length n that are divided from the waveform array M. The segment variance v(x) is found by $$V(x)=\Sigma_{j=1}^{n}(x_j-a(x))^2$$

where x is a vector (x1, x2, . . . , xn) that represents one bigit of a segment, and a(x) is the rounded average of x. To find a variance vector V, segment variances of all segments for every bigits need to be found, segment variances of the same bigit are then summed up, the sums for all these 16 bigits give out the variance vector V. The value of the variance vector V gives the rough variability level of different bigits, and the reason that variance found considers the segment issue is because embedding is done segment by segment and the variance of the segment determines whether it is embeddable or not, this is why segment variances are found and summed up to accumulate the total variability of the bigit. With the variance vector V, the bigit that vary the most till the one vary the least can be known, given this information, in partitioning of the waveform array M into two portions, an array M1 and an array M2, the bigit that vary lesser can be put to the less significant places if possible, and the bigit that vary more can be prevented to be put over there, so that the variances within the segments of the arrays M1 and M2 constructed will be smaller.

Figure 4:
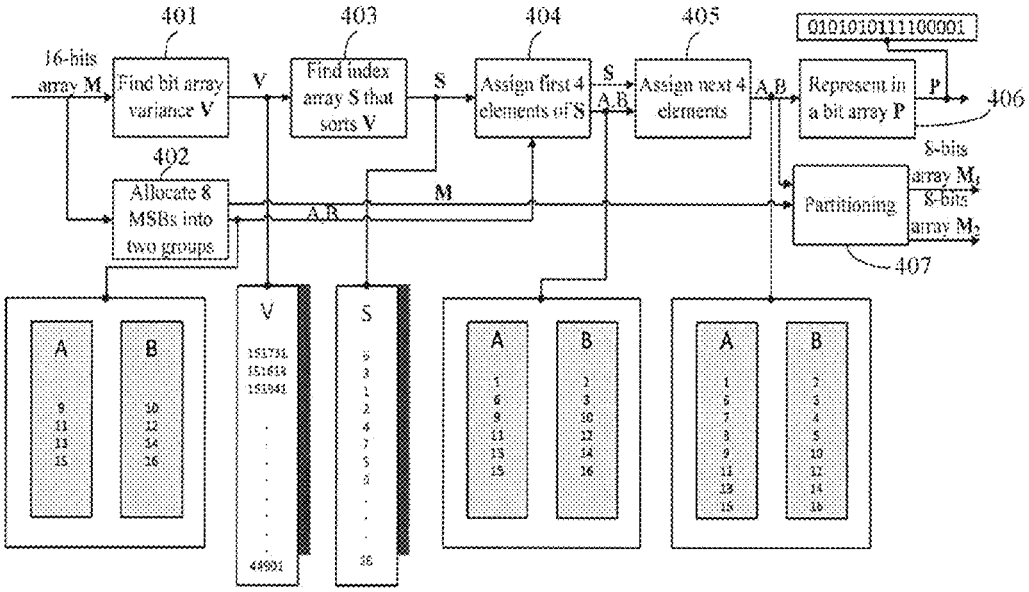
FIG. 4 shows the flowchart of intelligent partitioning according to an embodiment of the invention.

Details of the partitioning are shown in the flowchart of intelligent partitioning in FIG. 4. Referring to FIG. 4, after the variance vector V is found (block 401), an array S that lists the index that sorts the elements of the variance vector V in descending order is built, so that the order of the variability degree of the bigits is apparent. Followed by, create two groups A and B (block 402) that record the index of the waveform array M to represent the corresponding component of the waveform array M as components of the arrays M1 and M2, with elements of groups A and B being sorted, the arrays M1 and M2 will be given out with the bigits listed from the least significant one to the most significant one (block 403). The 8 most significant bigits of the waveform array M are assigned to groups A and B alternately, i.e. 9, 11, 13 and 15 are assigned to group A, while 10, 12, 14, 16 are assigned to group B, since the bit variation in this 8 bigits are similar, so equally partition these 8 bigits. With help of an index array S (created by sorting the variance vector V), excluding the indices just assigned, assign the first and the third elements of the index array S to group A, and the second and the fourth to group B, therefore, the bigits vary more can be distributed fairly into groups A and B, and thus preventing bigits vary a lot to be put in very significant places (block 404). Two of the remaining 4 indices are then assigned to group A and the other two are assigned to group B with the target that completed groups A and B will give out the arrays M1 and M2 which have the bigits that vary more to be put in the lesser significant places (block 405). From groups A and B, refer to the waveform array M to find the corresponding component to build up two partitions of the waveform array M, the partition that contains the least significant bit of the waveform array M will be the array M2, while the other will be the array M1 (block 407). Finally, a 16-bit partition bit array P is produced based on groups A and B (block 406).

Figure 5:
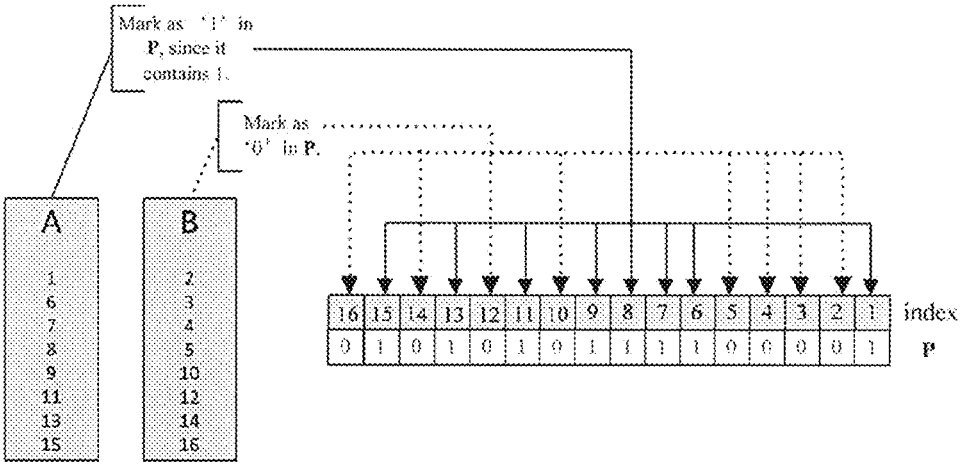
FIG. 5 shows representation of groups A and B by a bit array P according to an embodiment of the invention.

FIG. 5 shows representation of groups A and B by a bit array P. Referring to FIG. 5, in the bit array P, the group elements are represented by marking the corresponding element with the group element value as its index. Elements in same group are marked by the same bit value, and the group contains '1' as its element is marked as '1' in the bit array P, while the other is marked as '0'. In this way, with bigits vary more to be lesser significant bigits, the variance of the segments of the arrays M1 and M2 will be smaller, so more segments belong to the embeddable group and larger watermark can be embedded.

The reason that the partition that contains the least significant bit of the input audio array M will be the array M2 is because in the data hiding process of the array M2, the bit array P is embedded into the first 16 LSBs, in order to extract the bit array P in extraction procedure, the bigit that is the LSBs of the array M2 after result combination of two partitions must be known in advance, so that the extraction can be proceeded. The solution is to set the partition with the least significant bit of the waveform array M as the array M2, so the LSBs of the array M2 will be the LSBs of the waveform array M after combination, therefore, extraction of the bit array P can be done simply by extracting the first 16 LSBs of the bit array M. In addition, since the watermark W is divided into two portions, W1 and W2, and these portions are embedded in different partitions of the waveform array M, there is a need to distinguish the partitions from each other in the extraction process, so that correctly concatenating the watermarks W1 and W2 can be achieved. In the data hiding algorithm, it embeds the first portion W1 into the array M1, and the second portion W2 into the array M2, so identifying the partitions is crucial. This is why there is rule for marking the arrays M1 and M2 in the bit array P, marking the partition that contains the least significant bit of the waveform array M, i.e. the array M2, as '1' and the array M1 as '0' in the bit array P, by this way, identification of partitions in extraction can be ensured.

To summarize the intelligent partitioning above, we can obtain the algorithm of steps for intelligent partitioning below, where input: 16-bit audio waveform M (as the form of array); and output: partition bit array P, partitioned 8-bit arrays M1 and M2.

Step 1: Find the bitwise variance V(i) for every bigit i of M to form V, with $V=(V(\mathbf{1}), V(\mathbf{2}), \ldots, V(\mathbf{16}))$, $V(i)=\Sigma_{k=1}^{m/n} v(x_{ik})$ and $v(x_{ik})=\Sigma_{j=1}^{n}(x_{ik}))^2$, where m is the length of M, n is the length of the segments of M, $x_{ik}$ is the segment vector $(x_{ik1}, x_{ik2}, \ldots, x_{ikn})$ of the kth segment of bigit i and $a(x_{ik})$ is the rounded average of $X_{ik}$.

Step 2: Get an index array S formed by index of V, i.e. 1 to 16, sorting by V(i) in descending order.

Step 3: Assign the 8 most significant places, i.e. 9 to 16 bigits, to two groups A and B alternately.

Step 4: Excluding the elements have been assigned in previous step, assign the first and third elements of S into group A, and second and fourth elements into group B.

Step 5: Assign the next 4 elements of S into group A and group B, with two elements in each group, with the target that after sorting, group A and group B have i with high V(i), i.e. the bigit with high variance, being the first or second smallest number in the group.

Step 6: Partition M, according to the sorted A and B with their elements as the bigit places, into two portions M1 and M2.

Step 7: Represent A and B as a 16-bit partition bit array P, elements in same group are represented by marking corresponding index of the array with element value as the index by the same bit value, the group with bigit 1 as its element is marked as '1' in P, while the other is marked as '0'.

Data Hiding Procedure.

According to an embodiment of the invention, we can perform audio data hiding by utilizing the algorithm for intelligent partitioning.

In the proposed embedding procedure, at first, waveform of 16-bit quantization audio input are partitioned into two 8-bit arrays M1 and M2 by intelligent partitioning algorithm. Followed by, the image data hiding scheme that has been modified for one-dimensional input are applied twice, once with the array M1 as input and once with the array M2 as the input.

Figure 6:
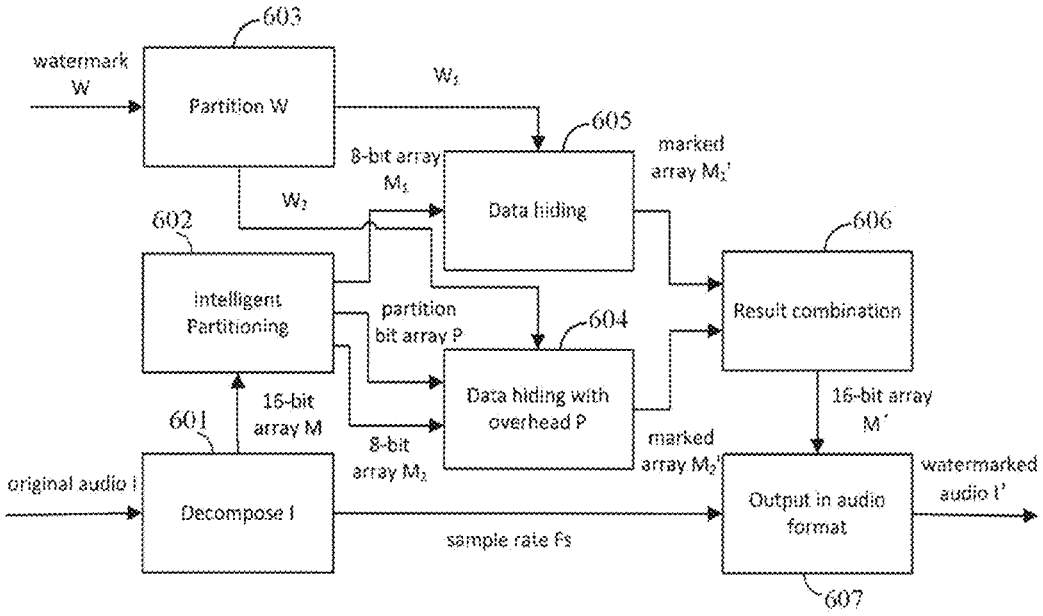
FIG. 6 shows a flowchart of the proposed embedding procedure according to an embodiment of the invention.

For better illustration, flowchart of the proposed embedding procedure is shown in FIG. 6. Referring to FIG. 6, to partition the 16-bit quantization input audio into two portions, the audio I is first decomposed into 16-bit waveform array M and sample rate Fs (block 601), intelligent partitioning mentioned previously is then applied to the waveform array M to partition it into two portions M1 and M2, with the target that more data can be embedded and less distortion is introduced to the marked audio that will be given out (block 602). With arrays M1 and M2 produced, two data hiding processes are then carried out in the embedding procedure, one for each portion; the data hiding processes carried out here are similar to the embedding procedure of the image watermarking scheme based on. As there are two data hiding processes, two watermarks W1 and W2 are needed, which can be found by simply dividing the input watermark W (information or data which are to be hided) by half, with the watermark W1 as the first portion and the watermark W2 as the second portion. Also, we can split up the watermark W according to the size of the watermark that can fully be embedded in the array M1 to give out watermarks W1 and W2. Either way is feasible, we can choose the way depends on our intention, the former way can maintain better acoustic quality, while the latter can achieve higher embedding space (block 603). As all the inputs for the data hiding processes are available, embedding of the watermarks W1 and W2 can be proceeded (block 604), however, one more thing needs to be noticed, the partition bit array P, which records how the waveform array M is partitioned, needs to be stored and embedded as an overhead to the audio (block 604), so that in the extraction procedure, the marked audio waveform can be partitioned in the same way as it was in the embedding procedure.

In order to record the bit array P, the first 16 LSBs of the array M2 are used for this purpose. To do so, after normal embedding of the location map in the array M2, the first 16 LSBs are recorded by embedding them in reverse order starting from the last segment of the array M2, they are embedded in the same way as the location map, i.e. bits are embedded into the embeddable segments or changeable segments, where generalized integer transform is applied for the embedding in the embeddable segments, and LSB replacements are used for changeable segments, bits being replaced in the LSB replacement in changeable segments are attached to the watermark, and are embedded together with the watermark in later step, the way that the watermark embedded remains the same. After recording the original values of the 16 LSBs, they are replaced by the bit array P, and the embedding of the watermark together with attached bits is executed (block 605).

Figure 7:
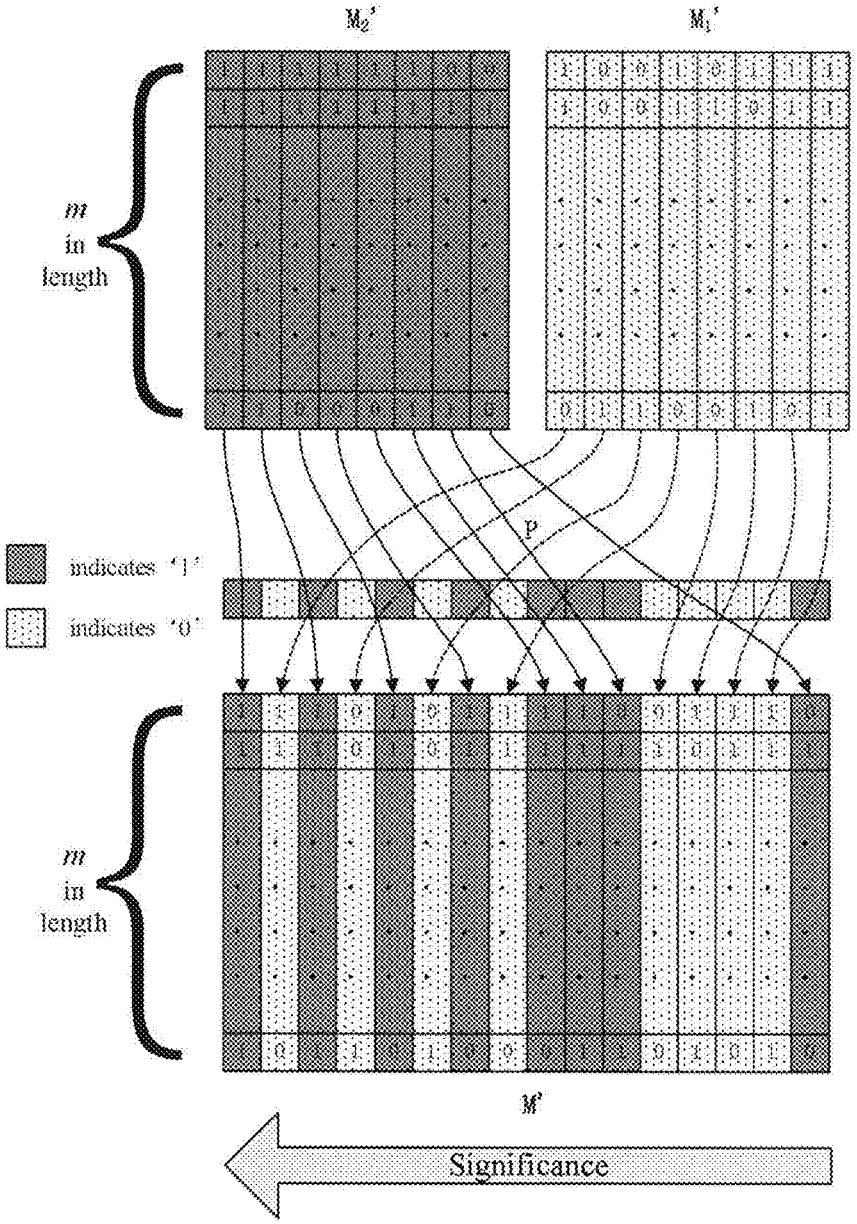
FIG. 7 shows combination of the arrays M1' and M2' referring to the partition bit array according to an embodiment of the invention.

After the data hiding processes for the watermarks W1 and W2, marked contents M1' and M2' are given out, result combination is then followed by (block 606). The technique to combine the results is to refer to the partition bit array P produced in intelligent partitioning, according to the way how the waveform array M is partitioned, combine marked arrays M1' and M2' to form a array M' as shown in FIG. 7. Referring to both FIG. 6 and FIG. 7, to build the stego audio waveform M' from the arrays M1' and M2', in the bit array P, when I' appears, take one bigit from the array M2', else take one bigit from the array M1', bigits from the arrays M1' and M2' are taken in order until all have been taken, whole 16-bit M' is built. Finally, with the information Fs got previously, marked content is turned into audio format and watermarked audio I' is formed (block 607).

To summarize the data hiding described above, we can obtain the algorithm of steps for embedding procedure below, where input: original audio I and watermark W; and output: watermarked audio Step 1: Get the audio waveform in form of an array M of 16-bits integer and sample rate Fs from I.

Step 2: Divide M into two 8-bits integer array M1 and M2 according to a partition bit array P found in Intelligent Partitioning process.

Step 3: Split W into two portions W1 and W2.

Step 4: Pass M1 and W1, M2 and W2 in two rounds to the generalized integer transform based data hiding process that has been adjusted to handle one dimensional (1D) digital signal, by dividing the input signal into segments instead of blocks for processing. In the case of the data hiding process of M2, after normal data hiding procedure, P is stored by LSB replacement of first few samples, original LSBs are recorded before replacement.

Step 5: Marked signal arrays M1' and M2' of 8-bits integer got from data hiding processes are combined according to the way how M is partitioned to give out the watermarked 16-bit integer waveform M'.

Step 6: With the information Fs, convert M' back to audio format to give out I'.

Extraction Procedure.

In order to customize the extraction procedure of the reversible image watermarking algorithm based on for the audio, the extraction algorithm is modified to divide the input into segments instead of blocks just like in the embedding procedure, so that one dimensional input can be handled. Moreover, the number of bits per sample is different between the 8-bit image and the 16-bit audio which also happened in the embedding process, in the embedding procedure, the problem is solved by partitioning the waveform into two portions and data hiding process is done two times, due to this reason, to restore the whole waveform, the image extraction algorithm needs to be employed twice to restore the two portions partitioned in the embedding procedure.

Figure 8:
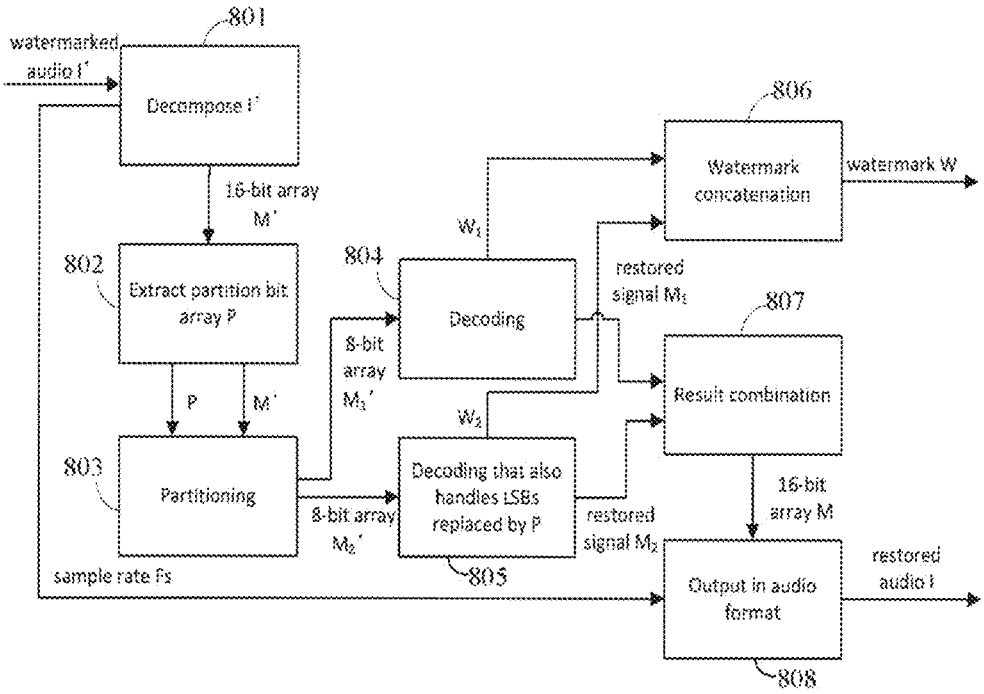
FIG. 8 shows a flowchart of extraction procedure according to an embodiment of the invention.

In FIG. 8, the flowchart of the extraction procedure is presented for general introduction. In order to get the waveform for extraction, the audio I' is first decomposed into 16-bit waveform array M' and sample rate Fs (block 801), from the watermarked array M', the partition bit array P is first extracted, so that partitioning of the watermarked array M' can be proceeded, the bit array P is extracted simply by reading the first 16 LSBs of the watermarked array M' (block 802). With the bit array P, the watermarked array M' is divided into two portions M1' and M2', when bit '0' appears in the bit array P, indicates that the corresponding bit array in the watermarked array M' belongs to the marked array M1', and with bit '1', indicates that the corresponding bit array belongs to the marked array M2', the sequences of the bigits in the marked arrays M1' and M2' follows the order in the watermarked array M', a bigit that comes before the other in the watermarked array M' will keeps that order in the marked arrays M1' or M2' (block 803).

Figure 9:
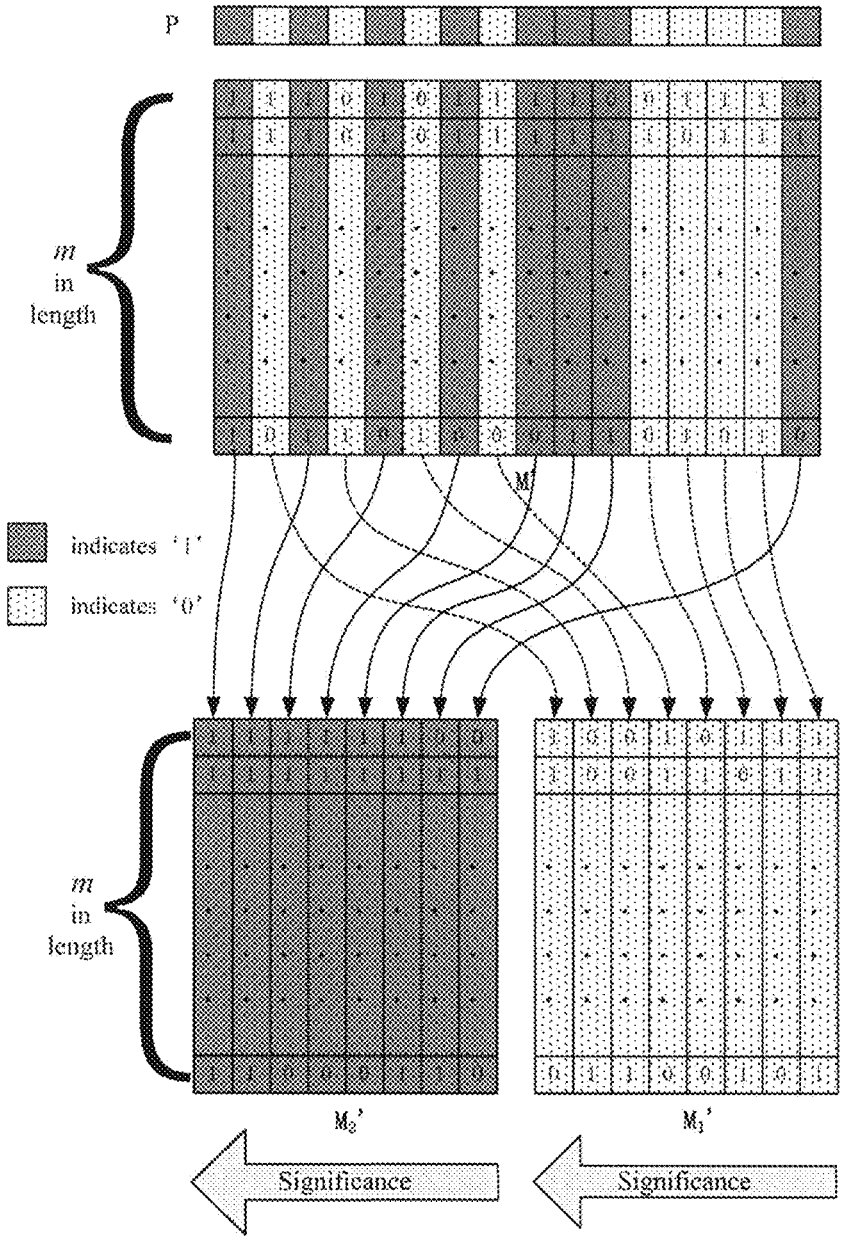
FIG. 9 shows a partitioning process according to an embodiment of the invention.

This partitioning process is shown in FIG. 9 for illustrating the block 803 of FIG. 8 specifically. Referring to FIGS. 8 and 9, The marked arrays M1' and M2' produced are then passed to their respective decoding processes that are based on the image extraction algorithm, which has been modified for one-dimensional input for restoration, the decoding process for the marked array M2' is a little different, as the marked array M2' consists of the LSBs of the watermarked array M' where part of the LSBs have been replaced in recording the bit array P, thus the first 16 LSBs of the marked array M2' that have been used to record the bit array P need to be restored first, so that restoration of other parts can start. The way to restore that 16 LSBs is to extract the first 16 bits from the embeddable or changeable segments in reverse order starting from the last segment of the marked array M2', in the same way as extraction of the location map, and the restoration of these segments is also similar to that of the location map. Followed by, that 16 bits extracted are used to replace the first 16 LSBs, to restore it to the state before they are being replaced by the bit array P, so that extraction of the watermark and restoration can continue.

The watermarks extracted from the decoding process of the arrays M1' and M2' are combined together to give out the final watermark W, with the watermark W2 being attached to the end of the watermark W1, the watermark W is composed, where the watermark W1 is the watermark extracted from the array M1' (block 804), and the watermark W2 is extracted from the array M2' (block 805). The reason that they are combined in this way is because the watermark W is divided into two portions in the embedding procedure, and with the front portion W1 being embedded into the array M1 and the last portion W2 being embedded into the array M2 (block 806). The other products of the decoding processes, the restored partitions, M1 and M2, need to be recombined in order to give out the restored waveform, the way to recombine them is to utilize the partition bit array P, and combine them in the same way as they are partitioned, just like in the embedding procedure. With the bit array P, the waveform array M is constructed according to the following rule, if '1' appears, one bit array is taken from the array M2, else one bit array is taken from the array M1, until the whole waveform M is built, the bit array taken from the arrays M1 and M2 is in sequence (block 807). Finally, output the waveform in audio format by joining the information, sample rate Fs, together with the restored waveform M to give out the restored audio I (block 808).

To summarize the extraction procedure described above, we can obtain the algorithm of steps for extraction procedure below, where input: watermarked audio I'; and output: original audio I and watermark W.

Step 1: Get the audio waveform in form of an array M' of 16-bit integer and sample rate Fs from Step 2: Extract the partition bit array P from the first 16 LSBs in M'.

Step 3: Partition M' into two portions M1' and M2' with help of P extracted, when the bit is '0', the corresponding bit array in M' is assigned to M1', where that of '1' is assigned to M2'.

Step 4: Pass M1' and M2' in two rounds to the generalized integer transform based extraction algorithm that has been adjusted to handle 1 D digital signal, by dividing the input signal into segments instead of blocks for processing. In the case of M2', the first 16 LSBs are restored before extraction starts.

Step 5: Restored signal arrays M1 and M2 in two rounds are combined according to the way how they are partitioned to give out M, and concatenate the extracted watermarks W1 and W2 to give out W.

Step 6: With the information Fs, convert the waveform array M back to audio format to give out I.

Figure 10:
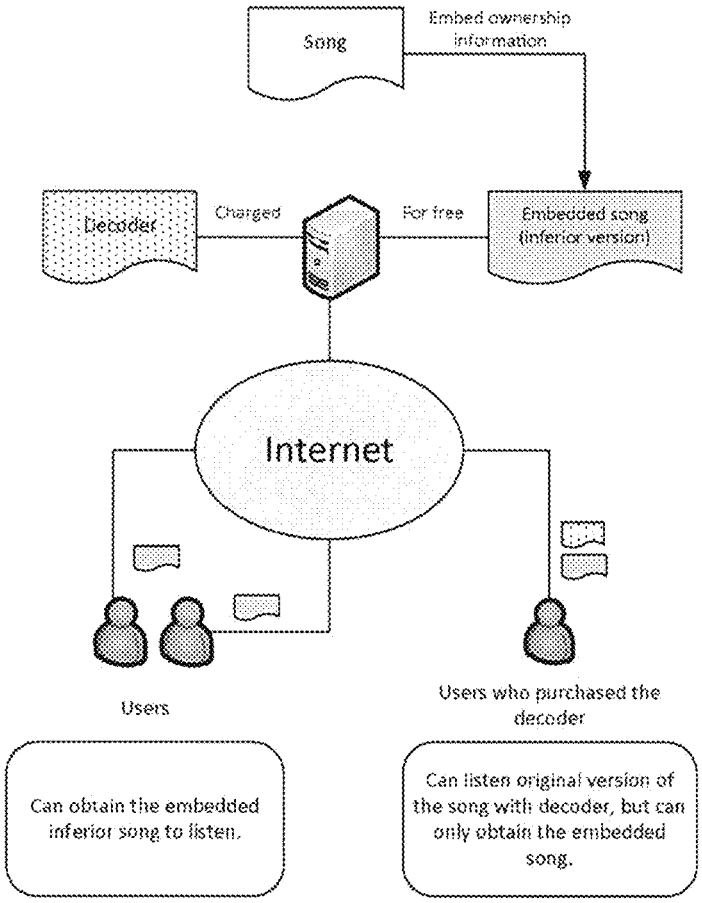
FIG. 10 illustrates an application using the present hiding data approach according to an embodiment of the invention.

FIG. 10 illustrates an application using the present hiding data approach according to an embodiment of the invention.

Referring to FIG. 10, with the characteristic that the present algorithm can embed satisfactory amount of data bits and the stego audio is perceptible but not annoying for large payload, a copyright protection application is proposed for the algorithm. The present application could be applied for protecting the copyright of songs or other music tracks, defending them from illegal or unauthorized usages. In the copyright protection application, the author or other authentication information is embedded into the audio, as the embedding capacity of the algorithm is acceptable in most cases, there are often enough spaces for embedding those information. With the information embedded, the ownership of the media can be identified, and the stego audio with these information embedded is perceptible, and the quality of the audio is obviously being degraded, and this inferior audio is the one that is being published to the public. By this way, the widely spread media that everyone can get is the inferior one, the original high quality version is not obtainable, only those authorized individual who has the decoder can decode and listen the original audio, others can only obtain and spread the inferior one, so illegal or disallowed uses of the original audio can be prevented.

For better copyright protection, the decoder can be built to restore the original audio and play it in real time without storing it, so the authorized individuals do not have the copy of the original audio and preventing them to spread it over the internet or through other means and any other unauthorized uses. With the feature that original audio is played in real time in the decoding process, the audio cannot be played immediately, time for the extraction procedure is needed before it can be played, in order to reduce its response time, the time needed for decoding before it can start playing, buffering is applied, audio starts playing when appropriate portion of the audio has been buffered. For buffering to be used, sequence of the processes in the extraction procedure is altered with the purpose that restoration of the audio can begin as soon as possible. In the first portion where location map is embedded, there are two types of segments being embedded, embeddable and changeable segments, where embeddable segments can be restored at the same time in the process of location map extraction and changeable segments need to obtain the bits has been replaced in LSBs replacement in embedding procedure before it can be restored. For this reason, location map extraction and restoration of the embeddable segments begins simultaneously, while the changeable segments start restoration only when the LSBs replaced are acquired in later process. For the portion followed by, LSBs replaced and watermark are embedded into the embeddable segments, therefore, segments can be restored together in the process of extracting the replaced LSBs and watermark, and as soon as the replaced LSBs for the changeable segments of the first portion are obtained, restoration of these segments set out. After the first portion has fully returned to the original state, the buffering for the first portion is done and the audio can start playing, and the rest of the audio where watermark and other LSBs are embedded are restored and played in real time simultaneously in the extraction process.

In fact, this application works like normal cryptography, original audio is protected from access by degrading its quality through embedding authenticated information into it in the encoding procedure, this encoding turns the original audio into an inferior stego audio which can be restored to its original form in the decoding procedure, only the individuals who have the decoder can listen to the original non-degraded audio.

As the stego audio is a degraded version of the original audio which can still preserve its melody, and it is normally widely published, for commercial uses, it can be used as a trial for listen version, the one who wants to listen to the original version can pay for the decoder. With the decoder purchased, the stego audio will be decoded and the original audio will be played without storage, through this technique, the audio can be distributed to desired individuals and protected from unauthorized uses.

According to an embodiment of FIG. 10, we can obtain the operation steps given below.

Step 1: Protect the song by embedding ownership information into it, and its quality is degraded in this process.

Step 2: Publish the inferior embedded song widely as a trial for listen version.

Step 3: Individuals who purchase the decoder can listen the original version by decoding the embedded song that is played in real time in the decoding process. Original version is not stored in the process, only the embedded version can be acquired.

Please be noted that the exemplary algorithm above with 16-bit quantization audio and 8-bit image is just an example and shall not be limited to the present invention. That is, in some cases, the present invention could be implemented with e.g. 24-bit quantization audio and 12-bit image. On the other hand, for example, 8-bit quantization audio data or 5-bit image data also could be used to perform the algorithm mentioned above while spanning the size of audio data from 8-bit to 16-bit or spanning the size of image from 5-bit to 8-bit by e.g. dithering algorithm.

The blocks in the Figures may have functions implemented with hardware, software, firmware or etc. When provided by a processor, the functions may be provided by a single dedicated processor, by a single shared processor, or by a plurality of individual processors, some of which may be shared. Moreover, those blocks should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their functions may be carried out through the operation of program logic, through dedicated logic, through the interaction of program control and dedicated logic, or even manually, the particular technique being selectable by the implementer as more specifically understood from the context.

CONCLUSION

In this paper, based on a recently proposed generalized integer transform reversible image watermarking scheme, a reversible audio watermarking algorithm is proposed. Intelligent partitioning is suggested to accomplish the algorithm. The result of the proposed algorithm is satisfactory, for small payload, SegSNR (segmental SNR) values are around 30 dB which are quite high. However, with large payload to be embedded, the stego audio is perceptual, but it is still not annoying for listening. In addition, the proposed method achieves a maximum embedding rate of more than 1 bit per sample for classic audio, since 441,444 bits can be embedded into 10 seconds of the audio with 44.1-kHz sampling frequency. Theoretically, it is believed that over 1 bit per sample embedding rate can be achieved for different types of audio when multilevel embedding is applied.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method, comprising:

sampling audio into a digital audio format by a first sampler;

protecting the audio by embedding ownership information into the sampled audio with a data processor according to variance calculation associated to the audio, wherein the quality of the protected audio is degraded but recognizable after embedding the ownership information into the audio;

publishing the protected audio widely in a communication network as a trial for listen version; and providing a decoder to decode the protected audio for a user who purchased the copyright of the audio via the communication network by extracting the original audio from the protected audio, wherein the step of protecting comprises:

obtaining a digital audio data array from the sampled audio;

partitioning the digital audio data array according to the variance calculation of the digital audio data array; and combining the ownership information with the partitioned digital audio data array, and wherein the variance calculation comprises:

forming a bit array variance $V=\{V(i)\}$, wherein V(i) is bitwise variance which is found for every bigit i of the digital audio data array; and wherein $V(i)=\Sigma_{k=1}^{m/n}v(x_{ik})$ and $V(Xik)=\Sigma_{j=1}^{n}(x_{ikj}-a(x_{ik}))^2$, where m is the length of the digital audio data array, n is the length of the segments of the digital audio data array, xik is a segment vector of the kth segment of bigit i and a(xik) is the rounded average of xik.

2. The method as claimed in claim 1, wherein the step of partitioning the digital audio data array comprises:

getting an index array formed by index of bit array variance according to the sorting of the bitwise variances in descending order.

3. The method as claimed in claim 2, wherein the bigit i is set from 1 to 16 and wherein the digital audio data array is obtained by 16-bit quantization of the audio waveform.

4. The method as claimed in claim 3, wherein the step of partitioning the digital audio data array comprises:

assigning 8 most significant elements of the index array to a first index group and a second index group alternately;

assigning the first and the third elements from the rest 8 least significant elements of the index array, and assigning the second and the fourth elements from the rest 8 least significant elements of the index array; and assigning the rest four elements of the index array into the first and the second index groups, with two elements in each index group.

5. The method as claimed in claim 4, wherein the step of partitioning the digital audio data array comprises:

partitioning the digital audio data array into two portions, according to the sorted first and second index groups with their elements as the locations of the corresponding bigits.

6. The method as claimed in claim 5, wherein the step of partitioning the digital audio data array comprises:

representing the first and the second index groups as a partition bit array, wherein elements in same group are represented by marking corresponding index of the partition bit array with element value as the index by the same bit value, and wherein the group with bigit 1 as its element is marked as "1" in the partition bit array while the other group is marked as "0".

7. The method as claimed in claim 6, wherein the step of combining the information with the partitioned digital audio data array comprises:

dividing the digital audio data array into a first and a second divided arrays according to the partition bit array;

splitting the information into a first information portion and a second information portion;

combining the first information portion with the first divided array as a first combined array by performing a generalized integer transform based data hiding process;

combining the second information portion with the second divided array as a second combined array by performing the generalized integer transform based data hiding process;

combining the first combined array with the second combined array as an information embedded array; and converting the information embedded array to an information embedded audio data with audio format and giving out information embedded audio waveform.

8. The method as claimed in claim 7, wherein the step of decoding comprises:

obtaining an information embedded digital audio data array through sampling the information embedded digital audio waveform by a second sampler with the same sample rate as the first sampler sampling the audio;

obtaining the partition bit array;

partitioning the information embedded digital audio data array back into the first combined array and the second combined array according to the indication from the partition bit array;

restoring the original digital audio data array and the original information by performing a generalized integer transformation based extraction on the first and the second combined arrays.

9. A copyright protection system, comprising:

a first sampler, to sample audio of a song into a digital audio format;

a data processor, used to protect the audio of the song by embedding ownership information into the sampled audio of the song according to variance calculation associated to audio of the song, wherein the quality of the protected song is degraded but recognizable after embedding the ownership information into the audio of the song;

a communication network, used for publishing the protected song widely as a trial for listen version; and a decoder, provided to a user who purchases the copyright of the song via the communication network, the decoder used the decoder used to decode the protected audio of the song by extracting the original song from the protected song, wherein the process of protecting a song comprises:

obtaining a digital audio data array from sampled audio waveform of the song;

partitioning the digital audio data array according to the variance calculation of the digital audio data array; and combining the ownership information with the partitioned digital audio data array, and wherein the variance calculation comprises:

forming a bit array variance $V=\{V(i)\}$, wherein $V(i)$ is bitwise variance which is found for every bigit i of the digital audio data array; and wherein $V(i)=\Sigma_{k=1}^{m/n} v(x_{ik})$ and $V(Xik)=\Sigma_{j=1}^{n}(x_{ikj}-a(x_{ik}))^2$, where m is the length of the digital audio data array, n is the length of the segments of the digital audio data array, xik is a segment vector of the kth segment of bigit i and a(xik) is the rounded average of xik.

10. The system as claimed in claim 9, wherein the process of partitioning the digital audio data array comprises:

getting an index array formed by index of bit array variance according to the sorting of the bitwise variances in descending order.

11. The system as claimed in claim 10, wherein the bigit i is set from 1 to 16 and wherein the digital audio data array is obtained by 16-bit quantization of the audio waveform.

12. The system as claimed in claim 11, wherein the process of partitioning the digital audio data array comprises:

assigning 8 most significant elements of the index array to a first index group and a second index group alternately;

assigning the first and the third elements from the rest 8 least significant elements of the index array, and assigning the second and the fourth elements from the rest 8 least significant elements of the index array; and assigning the rest four elements of the index array into the first and the second index groups, with two elements in each index group.

13. The system as claimed in claim 12, wherein the process of partitioning the digital audio data array comprises:

partitioning the digital audio data array into two portions, according to the sorted first and second index groups with their elements as the locations of the corresponding bigits.

14. The system as claimed in claim 13, wherein the process of partitioning the digital audio data array comprises s:

representing the first and the second index groups as a partition bit array, wherein elements in same group are represented by marking corresponding index of the partition bit array with element value as the index by the same bit value, and wherein the group with bigit 1 as its element is marked as "1" in the partition bit array while the other group is marked as "0".

15. The system as claimed in claim 14, wherein the process of combining the information with the partitioned digital audio data array comprises:

dividing the digital audio data array into a first and a second divided arrays according to the partition bit array;

splitting the ownership information into a first information portion and a second information portion;

combining the first information portion with the first divided array as a first combined array by performing a generalized integer transform based data hiding process;

combining the second information portion with the second divided array as a second combined array by performing the generalized integer transform based data hiding process;

combining the first combined array with the second combined array as an information embedded array; and converting the information embedded array to an information embedded audio data with audio format and giving out information embedded audio waveform.

16. The system as claimed in claim 15, wherein the process of decoding comprises:

obtaining an information embedded digital audio data array through sampling the information embedded audio waveform by a second sampler with the sample rate as the first sampler sampling the audio waveform;

obtaining the partition bit array;

partitioning the information embedded digital audio data array back into the first combined array and the second combined array according to the indication from the partition bit array; and restoring the original digital audio data array and the original ownership information by performing a generalized integer transformation based extraction on the first and the second combined arrays; wherein the user purchased the copyright of the song obtains the original song by converting the original digital audio data array into audio waveform.

* * * * *